US011004641B2

(12) United States Patent
Garcia-Ferre et al.

(10) Patent No.: US 11,004,641 B2
(45) Date of Patent: May 11, 2021

(54) THOMSON COIL DRIVEN SWITCH ASSEMBLY WITH LIGHTWEIGHT PLUNGER

(71) Applicant: ABB Schweiz AG, Baden (CH)

(72) Inventors: Francisco Garcia-Ferre, Baden (CH); Thomas Schmoelzer, Essen (DE); Jacim Jacimovic, Wettingen (CH); Lorenz Herrmann, Turgi (CH); Jakub Korbel, Baden (CH); Tobias Erford, Zürich (CH); David Saxl, Zürich (CH)

(73) Assignee: ABB Schweiz AG, Baden (CH)

( * ) Notice: Subject to any disclaimer, the term of this patent is extended or adjusted under 35 U.S.C. 154(b) by 189 days.

(21) Appl. No.: 16/404,050

(22) Filed: May 6, 2019

(65) Prior Publication Data

US 2019/0348242 A1 Nov. 14, 2019

(30) Foreign Application Priority Data

May 11, 2018 (EP) ..... 18171817

(51) Int. Cl.
*H01H 50/44* (2006.01)
*H01H 50/54* (2006.01)
*H01H 50/64* (2006.01)

(52) U.S. Cl.
CPC ..... *H01H 50/44* (2013.01); *H01H 50/54* (2013.01); *H01H 50/641* (2013.01)

(58) Field of Classification Search
CPC ..... H01H 50/44; H01H 50/54
See application file for complete search history.

(56) References Cited

U.S. PATENT DOCUMENTS

| | | | | |
|---|---|---|---|---|
| 7,235,751 | B2 * | 6/2007 | Liljestrand | H01H 9/40 200/239 |
| 2017/0084412 | A1 * | 3/2017 | Bujotzek | H01H 1/385 |
| 2020/0194206 | A1 * | 6/2020 | Wang | H01H 3/222 |
| 2020/0251295 | A1 * | 8/2020 | Angquist | H01H 50/44 |

FOREIGN PATENT DOCUMENTS

| | | | |
|---|---|---|---|
| DE | 2653077 | A1 | 6/1977 |
| EP | 2511928 | A1 | 10/2012 |
| EP | 2546847 | A1 | 1/2013 |
| EP | 2546848 | A1 | 1/2013 |
| EP | 3439013 | A1 | 2/2019 |
| WO | 2014053554 | A1 | 4/2014 |

* cited by examiner

*Primary Examiner* — Alexander Talpalatski
(74) *Attorney, Agent, or Firm* — Taft Stettinius & Hollister LLP

(57) ABSTRACT

An electrical switch assembly includes a contact element to be moved towards a further contact element for generating an electrical connection; and a drive for moving the contact element; wherein the drive includes a plunger with a connection member interconnected with the contact element; wherein the plunger includes a mechanical structure with a top side to which the connection member is connection, and a bottom side opposite to the top side; wherein the drive includes a Thomas coil for moving the plunger via an electrically conducting top face, which is provided on the top side and an electrically conducting bottom face, which is provided on the bottom side. The mechanical structure includes at least one channel between the top side and the bottom side, the at least one channel extending transverse to a movement direction of the plunger. Furthermore, the mechanical structure fills less than 50% of a volume between the top side and the bottom side.

20 Claims, 3 Drawing Sheets

THOMSON COIL DRIVEN SWITCH ASSEMBLY WITH LIGHTWEIGHT PLUNGER

FIELD OF THE INVENTION

The invention relates to an electrical switch assembly.

BACKGROUND OF THE INVENTION

One possibility to mechanically disconnect and connect conductors on high and medium voltage are electrical switches based on so called Thomson coil accelerators. Such an electrical switch may comprise a set of paddles that hold the contact elements, which are used for generating an electrical connection. The paddles are connected to an electromagnetic actuator, which may be a plunger that is moved by a Thomson coil.

Upon the action of currents induced in the Thomson coil, the plunger may be accelerated between two possible stable configurations that correspond to the open and closed position of the electrical switch, inducing a switching operation. The movement between the two configurations may be dampened by a bi-stable suspension. In order to enable a switching speeds as high as possible, the plunger and the attached paddles usually have to withstand extreme accelerations.

For example, EP 2 511 928 A1 shows a switch with two sets of contact elements and two drives.

EP 2 546 847 A1 and EP 2 546 848 A1 show electrical switches having a drive with a plunger, which is further provided with at least one cavity, which allows to reduce its weight.

DE 26 53 077 A1 shows a circuit breaker with an electrical conductive ring attached to a side of a plunger.

DESCRIPTION OF THE INVENTION

It is an objective of the invention to provide a fast and reliable electrical switch based on a Thomson coil.

This objective is achieved by the subject-matter of claim 1. Further exemplary embodiments are evident from the dependent claims and the following description.

The invention relates to an electrical switch assembly. The electrical switch assembly may comprise terminals, electrical contact elements for connecting the terminals and one or more drives for moving the contact elements. The electrical switch assembly also may comprise a housing, in which these components are accommodated and/or which may comprise an isolating gas, such as SF6.

It has to be noted that the electrical switch assembly may be adapted for switching medium voltages, such as voltages from 1 kV to 30 kV and high voltages, such as voltages above 50 kV.

According to an embodiment of the invention, the electrical switch assembly comprises a contact element to be moved towards a further contact element for generating an electrical connection and a drive (which may be seen as electromagnetic actuator) for moving the contact element. It may be that one or more contact elements are provided on paddles or plates, which are moved by the drive. At a special position, the contact elements are in mechanical contact and generate an electrically conducting path between two terminals of the electrical switch assembly.

The drive comprises a plunger with a connection member interconnected with the contact element, wherein the plunger comprises a mechanical structure with a top side to which the connection member is connected, and a bottom side opposite to the top side. The drive furthermore comprises a Thomson coil for moving the plunger via an electrically conducting top face, which is provided on the top side of the plunger, and an electrically conducting bottom face, which is provided on the bottom side of the plunger.

The terms "top" and "bottom" need not define a direction with respect to the surface of the earth, but may refer to the movement direction of the plunger. The top side may be, where the connection member is provided and the bottom side may be the opposite side.

The plunger and the Thomson coil may be accommodated in a housing of the drive. The plunger may be connected with the connection member to one or more paddles or plates that carry the one or more connection elements. The plunger may be guided in the housing to be moved between a first position, where the contact element is not in contact with the further contact element and a second position, where the contact element is in contact with the further contact element. In the first position, the switch assembly may be opened. In the second position, the switch assembly may be closed.

The plunger comprises electrically conducting faces, which may be directed into a direction parallel to the movement direction of the plunger, i.e. they may lie in a plane orthogonal to the movement direction. The electrically conducting faces may be ring like shaped, which may be aligned with windings of the Thomson coil.

The Thomson coil may comprise windings arranged in planes orthogonal to the movement direction. When a current is generated in the Thomson coil, the Thomson coil induces a current in the electrically conducting faces, and the generated magnetic fields produce a force on the plunger. With this force, the plunger may be accelerated and moved from the first to the second position and vice versa.

Since the force for moving the plunger and the connected mechanical components is directly proportional to the mass of these moving components, a lightweight design of these parts may be beneficial. For a given acceleration, a lower mass will require a lower force. In such case, the requirements on the drive may be relaxed. Vice versa, if the force from the electrical drive is fixed, then a lower mass will result in higher accelerations. In this case, the switching operation may be faster. On the other hand, the moving components involved must withstand the high forces during switching. The plunger may account for as much as 45% of the total mass of the moving components. A plunger which is both as light and as stiff as possible may allow enhancing the performance of the switch assembly, provided it retains structural integrity at all times.

The electrically conducting faces, which are provided on the top and bottom sides of the plunger, and the connection member, are mechanically interconnected with each other via a mechanical structure. This mechanical structure may provide the top and bottom side of the plunger and optionally may provide at least partially the connection member.

According to an embodiment of the invention, the mechanical structure comprises at least one channel between the top side and the bottom side, the at least one channel extending transverse to a movement direction of the plunger. The extension direction in the transverse direction may be longer as in the movement direction itself. It has to be noted that transverse may mean an orthogonal direction with respect to the movement direction. A channel may be a cavity between posts and/or struts. A channel may be a bore.

Such a channel may have openings towards a narrow side of the plunger. The narrow side of the plunger may circumvent the plunger between the top side and the bottom side.

According to an embodiment of the invention, the mechanical structure fills less than 50% of a volume between the top side and the bottom side. This may substantially reduce the weight of the plunger. The space occupied by the plunger between the top side and the bottom side may have more volume without plunger material as volume filled with this material. This may result in a lightweight drive.

In general, the plunger may be seen as an ensemble of functional subassemblies: a connection member, one or two electrically conducting faces, which may be arranged orthogonal to the connection member, and a mechanical structure interconnecting the connection member and the two electrically conducting faces. Furthermore, the plunger may comprise cavities and/or pockets, in which a sensor may be arranged. The mechanical structure enables tailoring such properties as stiffness, elasticity, compliance, etc. while achieving a combined effect of lightweight.

According to an embodiment of the invention, a cross section through the mechanical structure parallel to the bottom side has an area less than 40%, for example less than 20%, of the area of the bottom side. It may be that the mechanical structure has one or more regions between the top side and the bottom side, which are nearly empty. In such a region, the mechanical structure may comprise interconnection elements, such as bars, struts, links, etc., interconnecting the top side with the bottom side. Such interconnection elements may be thinner and/or smaller than the space besides them. A projection of such a region onto the bottom side or the top side may occupy 20% or less of the area of the bottom side or the top side.

According to an embodiment of the invention, the mechanical structure comprises a top plate, which may provide the top side, and/or a bottom plate, which may provide the bottom side. At the top side and the bottom side, the mechanical structure may occupy nearly all of the available space and/or area. The top plate and/or the bottom plate may be aligned parallel to each other. The one or more channels in the transverse direction may be arranged between the top plate and the bottom plate. The top and bottom plate also may provide walls of the one or more channels.

According to an embodiment of the invention, the top side and the bottom side are interconnected with struts and/or a network of struts. A strut is an interconnection element, which may be formed like a rod and/or a post. The maximal diameter of a strut in its middle part may be smaller than a length of the strut. By arranging the plunger material in struts, a lightweight and stiff mechanical structure of the plunger may be achieved.

The struts may interconnect the top plate and the bottom plate.

According to an embodiment of the invention, at least some of the struts are inclined with respect to the top side and the bottom side. However, it also may be possible that the struts are aligned orthogonal to the top side and the bottom side. Inclined struts may increase the stiffness of the mechanical structure. The struts may be aligned along directions not orthogonal and/or parallel to the top side and the bottom side.

It also may be that the top side and the bottom side (or the top plate and the bottom plate) are interconnected with posts and/or struts, which are aligned in parallel to the top side and the bottom side. It may be that all posts and struts between the top side and the bottom side are aligned in this direction.

According to an embodiment of the invention, for at least some of the struts, the extension direction of the struts is directed towards the connection member. For example these struts may be aslant with respect to the movement direction of the plunger. Such struts may absorb forces between the connection member and the other parts of the plunger.

According to an embodiment of the invention, the mechanical structure has an irregular pattern. For example, some or all of the struts of the mechanical structure may be arranged in an irregular pattern. Such struts may be aligned with respect to each other non-parallel, non-orthogonal, aslant and/or with respect to different angles.

As a further example, the channels and/or bores between the top side and the bottom side may be arranged in an irregular pattern. Such channels and/or bores may be aligned with respect to each other non-parallel, non-orthogonal, aslant and/or with respect to different angles.

According to an embodiment of the invention, the plunger comprises a cavity, in which a sensor is arranged. For example, cavities with an opening towards the top side and/or the bottom side may be adapted for accommodating a sensor. Such a sensor may be adapted for measuring the position and/or the acceleration of the plunger.

The form of the struts of the mechanical structure may be determined with a process, in which the amount of material of the plunger is reduced as much as possible, while its stiffness is maximized. Such a process may result in a network of free-shape bionic struts.

It is possible that struts join each other and/or split between the top side and the bottom side.

In general, the plunger may be manufactured in a single or a multiple step process, comprising traditional methods (such as machining or casting) and/or additive manufacturing methods. The subassemblies, such as the connection member, the mechanical structure, the electrically conducting faces, etc., may be processed independently. The subassemblies may be joined by welding, brazing, screwing, and/or combinations thereof, etc.

According to an embodiment of the invention, at least a part of the mechanical structure is obtained by additive manufacturing methods. For example, by powder bed fusion of a Ti alloy, such as Ti6Al4V. Such a manufacturing method may be beneficial for forming a network of individually optimized struts.

According to a further embodiment of the invention, at least a part of the mechanical structure is obtained by reductive methods (such as machining, channels, bores and/or cavities into a solid block of material). For example, pieces of the mechanical structure may be machined away for reducing the weight of the plunger. The plunger may be machined and/or drilled from a solid block of material to obtain the desired geometrical shape and limit the mass to the lowest possible values. For example, the mechanical structure and/or the plunger may be machined from an Al alloy block.

It may be that the mechanical structure is assembled of one or more parts that have been made with additive manufacturing methods and of one or more parts that have been made with reductive manufacturing methods. However, it also may be possible that the mechanical structure is solely made with one manufacturing method.

According to an embodiment of the invention, the mechanical structure comprises a plurality of channels (such as bores) running parallel to each other and parallel to the top plate and the bottom plate. Between the channels and/or bores, posts and/or bars may remain that interconnect the top side with the bottom side.

According to yet another embodiment of the invention, the mechanical structure and the connection member are a single piece. This may be achieved either with additive or reductive methods. However, it also may be that the connection member is joined with the mechanical structure after both parts have been manufactured independently from each other, as mentioned above.

According to an embodiment of the invention, the connection member comprises at least one arm protruding orthogonal from the top side and having holes for connecting the contact element. One or more paddles for carrying contact elements may be arranged between and/or besides such arms. The paddles also may have holes and may be connected to the arm with a bolt and/or screw.

According to an embodiment of the invention, at least one of the arms is hollow. It may be that the arm is provided by a hollow member that is composed of plates, which provides walls of the arm. This may further reduce the weight of the plunger.

It also may be that struts are used for stabilizing the connection member. Such a strut may join a part of the connection member with a part of the mechanical structure, such as the top plate and/or the bottom plate.

According to an embodiment of the invention, the electrically conducting top face and the electrically conducting bottom face are metallic layers and/or metallic plates of a different material as the material of the mechanical structure.

The top face and/or the bottom face may be coated on the top side and/or the bottom side, for example by cold spraying or sputtering. One or both faces may be provided by metallic plates, which are bonded to the top side and/or the bottom side, such as by soldering and/or welding.

The top face and the bottom face may be made of copper. The mechanical structure may be made of another metal material, such as an Ti alloy or an Al alloy.

According to an embodiment of the invention, the Thomson coil comprises a top coil and a bottom coil, which are arranged parallel to each other. The top coil and the bottom coil may be arranged in a housing, in which the plunger is movably accommodated. The electrically conducting top face and the electrically conducting bottom face may be arranged between the top coil and the bottom coil. By applying a voltage to the coils, a current is induced in the electrically conducting faces, which generates forces, which move the plunger between two positions.

According to an embodiment of the invention, the drive comprises a bistable suspension for holding the plunger in a top position and a bottom position. The bistable suspension may comprise a link connected to the plunger and to a piston movable in a cylinder orthogonal to a movement direction of the plunger. In particular, the mechanical structure also may provide attachment means for the link.

According to an embodiment of the invention, the mechanical structure comprises attachment plates, which are aligned orthogonal to the top side and the bottom side and each of which has a hole for connecting the bistable suspension. A link of the bistable suspension may be connected to at least one of the attachment plates, for example with a screw and/or bolt through the hole in the attachment plate.

According to an embodiment of the invention, the electrical switch assembly further comprises a second drive for moving the further contact element towards the contact element. The second drive and in particular its plunger may be designed like the drive described above, which may be seen as a first drive.

These and other aspects of the invention will be apparent from and elucidated with reference to the embodiments described hereinafter.

BRIEF DESCRIPTION OF THE DRAWINGS

The subject-matter of the invention will be explained in more detail in the following text with reference to exemplary embodiments which are illustrated in the attached drawings.

The reference symbols used in the drawings, and their meanings, are listed in summary form in the list of reference symbols. In principle, identical parts are provided with the same reference symbols in the figures.

DETAILED DESCRIPTION OF EXEMPLARY EMBODIMENTS

Figure 1:
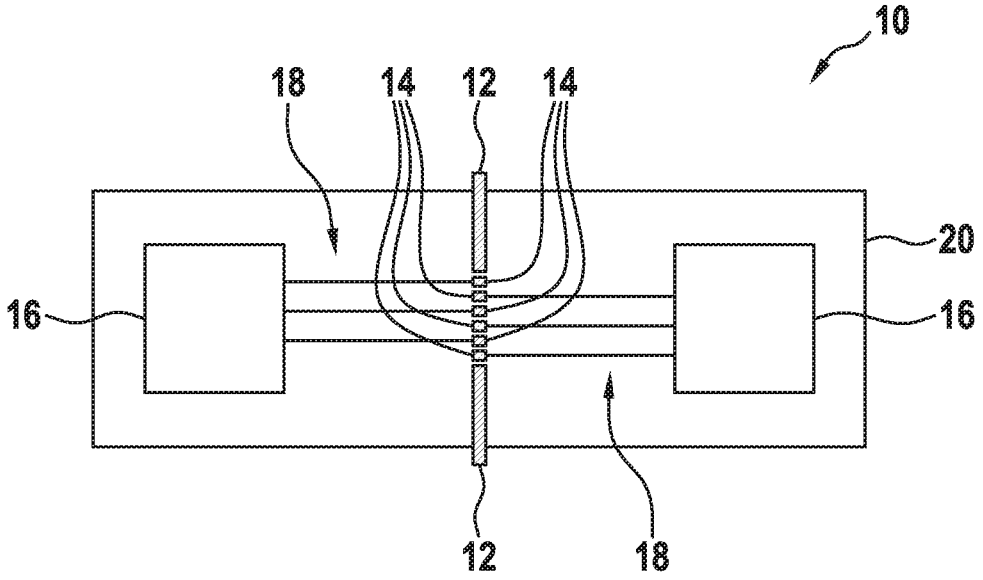
FIG. 1 schematically shows a switch assembly according to an embodiment of the invention.

FIG. 1 shows an electrical switch assembly 10, which comprises two terminals 12, which may be electrically interconnected and disconnected with contact elements 14, which are moved towards each other or away from each other with the aids of two drives 16.

The contact elements 14 are provided on paddles 18, which may be seen as a part of the respective contact element 14 and/or which are aligned parallel to each other, when the paddles 18 connected to one drive 16 are moved away from the paddles 18 connected to the other drive 16, the contact elements 14 are moved away from each other and the electrical switch assembly 10 opens. Vice versa, when the paddles 18 connected to one drive 16 are moved towards the paddles 18 connected to the other drive 16, the contact elements 14 are moved towards each other and the electrical switch assembly 10 closes. In FIG. 1, the electrical switch assembly 10 is shown in a closed position.

The components 12, 14, 16, 18 of the electrical switch assembly 10 may be accommodated in a housing 20, which may be filled with an isolating gas, such as SF6.

Figure 2:
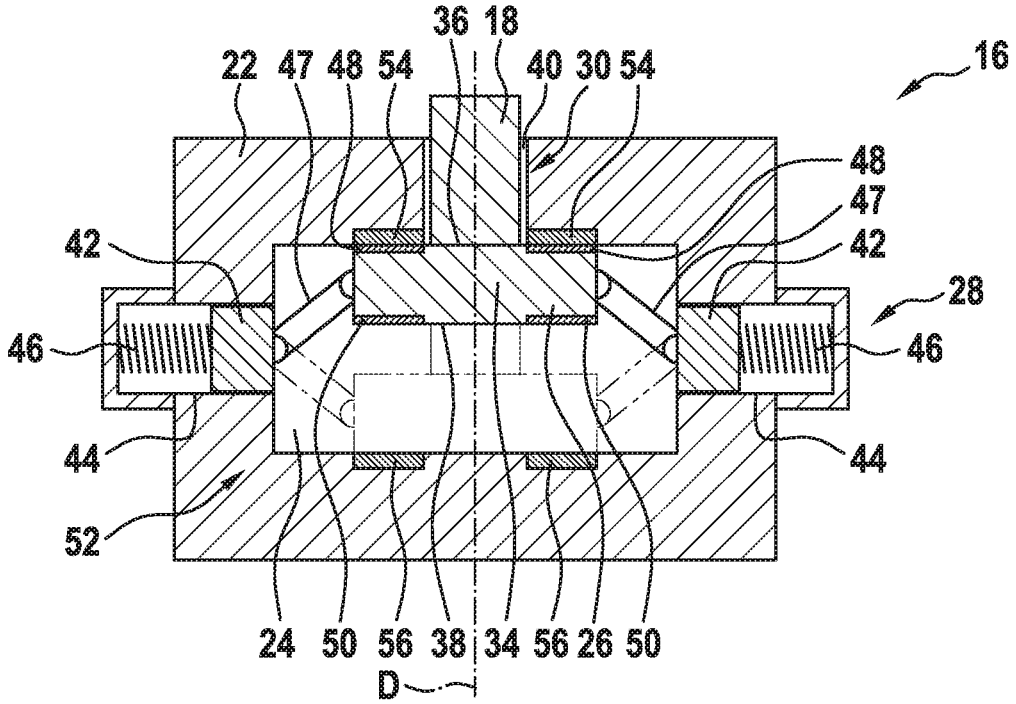
FIG. 2 schematically shows a cross-section of a drive of a switch assembly according to an embodiment of the invention.

FIG. 2 shows a drive 16 in more detail. The drive comprises a housing 22 enclosing a chamber 24. A plunger 26 is arranged within the chamber 24 and held by a bistable suspension 28. The plunger 26 is guided in the housing 22 and movable along a direction D from a first or top position (as shown in FIG. 2) to a second or bottom position (as indicated in FIG. 2).

The plunger 26 comprises a connection member 30 and a base 32 which is wider than the connection member 30. The base 32 comprises a mechanical structure 34 with a top side 36 and a parallel bottom side 38, with both are aligned orthogonal to the direction D.

The connection member 30 is attached to the top side 36. With the connection member 30, the plunger 26 is connected to the paddles 18. The paddles 18 and the connection member 30 extend through an opening 40 in the housing 22.

The bistable suspension 28 comprises two pistons 42 movable along cylinders 44 in a direction orthogonal to the direction D. The pistons 42 are pushed towards chamber 24 by springs 46. Each piston 42 is connected to the plunger 26 with a link 47. Each link 47 is formed by a substantially rigid rod, which is, at a first end, rotatably connected to its piston 42 and, at a second end, rotatably connected to a side of the plunger 26.

The plunger 26 comprises an electrically conducting top face 48 at the top side 36 and an electrically conducting bottom face 50 at the bottom side 38, which both are ring-shaped and surround an axis of the plunger 26 (which axis runs along line D).

For moving the plunger 26, the drive 16 comprises a Thomson coil 52, which comprises a top coil 54, which is provided in the housing 22 opposite to the top side 36 of the plunger 26, and a bottom coil 56, which is provided in the housing 22 opposite to the bottom side 38 of the plunger 26.

For example, when the plunger 26 is in the first position and a current pulse is sent through the top coil 54, a mirror current is generated within the top face 48, which leads to a repulsive force that accelerates the plunger 26 away from the top coil 54 to the second position. Analogously, the plunger can be moved from the second to the first position with a current pulse through the bottom coil 56.

Figure 3:
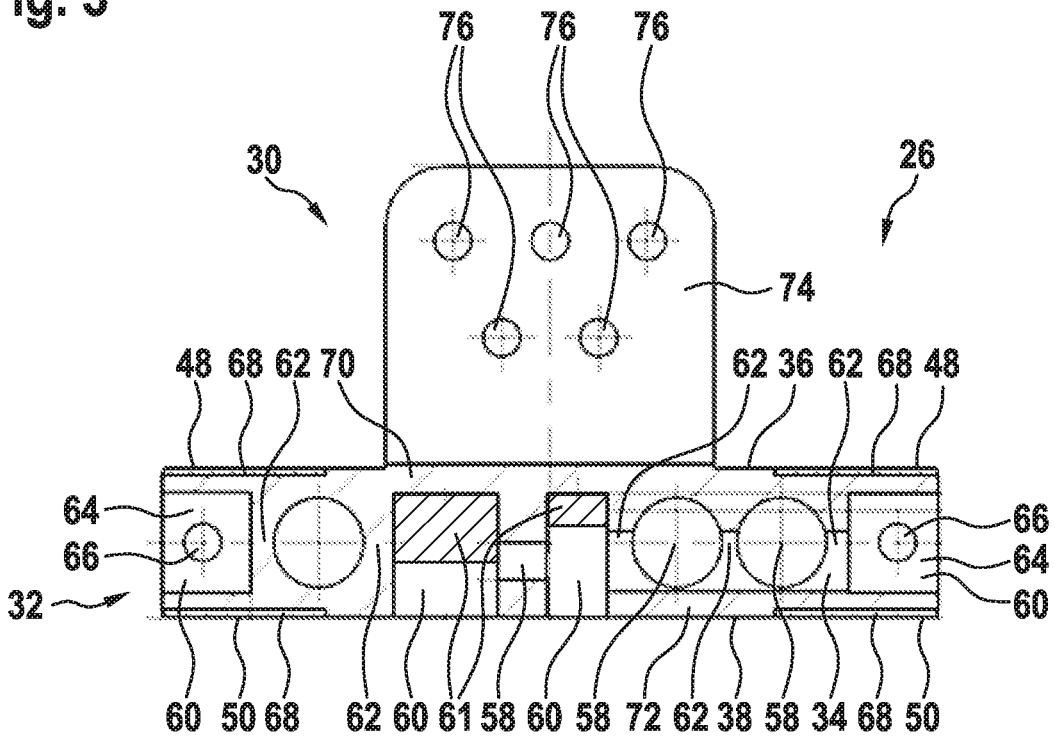
FIG. 3 shows a cross-section of a plunger of a switch assembly according to an embodiment of the invention.
Figure 4:
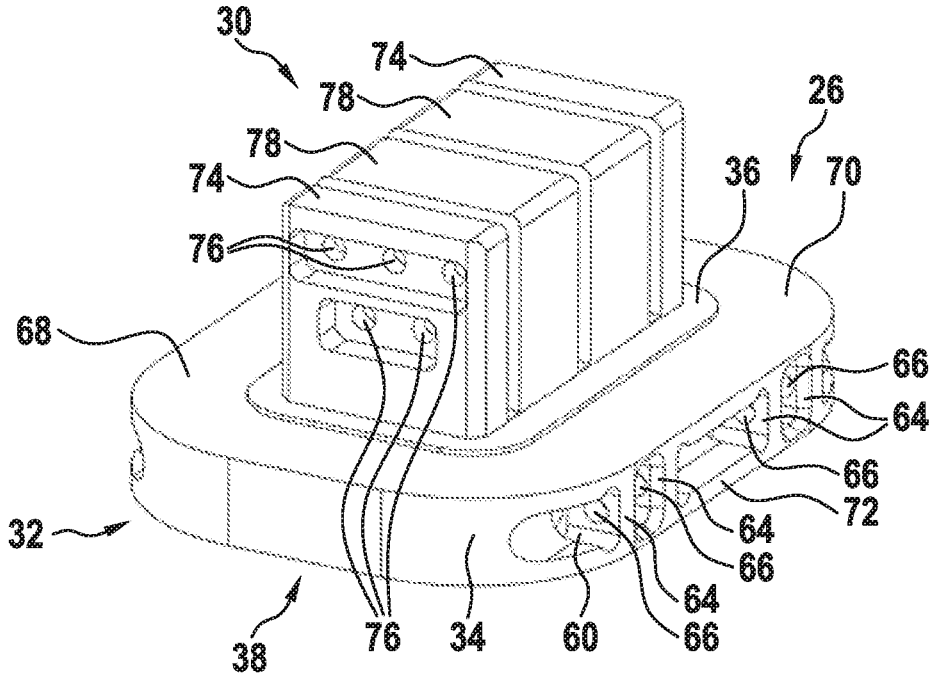
FIG. 4 shows a perspective view of the plunger of FIG. 3.

FIGS. 3 and 4 show an embodiment of a plunger 26, which is machined from a solid block of metal material, such as an Al alloy. The connection member 30 and the mechanical structure 34 are made in one-piece by machining the block of metal material.

The mechanical structure 34 is made by machining channels 58 in form of bores and cavities 60 into the block of metal material. The mechanical structure has been machined in such a way that 50% or more material has been removed from the material between the top side 36 and the bottom side 38.

Some of the channels 58 may be aligned in parallel to the top side 36 and the bottom side and/or orthogonal to the movement direction D. These channels 58 may only have an opening towards a side of the mechanical structure 34.

Furthermore, some channels and/or bores 58 and/or cavities 60 may have an opening towards the bottom side 38. In a cavity or pocket 60, which may have an opening towards the bottom side 38, one or more sensors 61 may be housed, which may measure the position and the acceleration of the plunger 26. This may provide useful data for lifetime prediction of the plunger 26.

Between these bores, small bars and/or posts 62 are formed, which interconnect the top side 36 with the bottom side 38. The overall area of these bars and/or posts 62 may be smaller than 20% of the area of the top side 36 or the bottom side 38.

At opposite sides of the plunger 26, attachment plates 64 are provided in the mechanical structure, which are aligned orthogonal to the top side 36 and the bottom side 38 and/or parallel to the movement direction D. These attachment plates 64 have a hole 66, to which a link 47 of the bistable suspension 28 may be connected.

The electrically conducting top face 48 and the electrically conducting bottom face 50 are provided in a depression 68 in the top side 36 and the bottom side 38. The electrically conducting faces 48, 50 are not shown in FIGS. 4 to 6. The electrically conducting faces 48, 50 may be coated onto the respective side 38, 38 of the mechanical structure 34 and/or may be plates attached in the depressions 68, for example by welding, gluing, soldering, etc. The electrically conducting faces 48, 50 may be made of Cu.

The depressions 68 are formed in a top plate 70 and bottom plate 72 of the mechanical structure 34, which are formed, since no or less material has been removed from the machined block.

To the top plate 70, the connection member 30 is connected, which is formed of four arms 74, 78, which all have holes 76 orthogonal to the movement direction D and/or in parallel to the top side 36 and the bottom side 38. The two outer arms 74 are smaller than the two inner arms 78.

Figure 5:
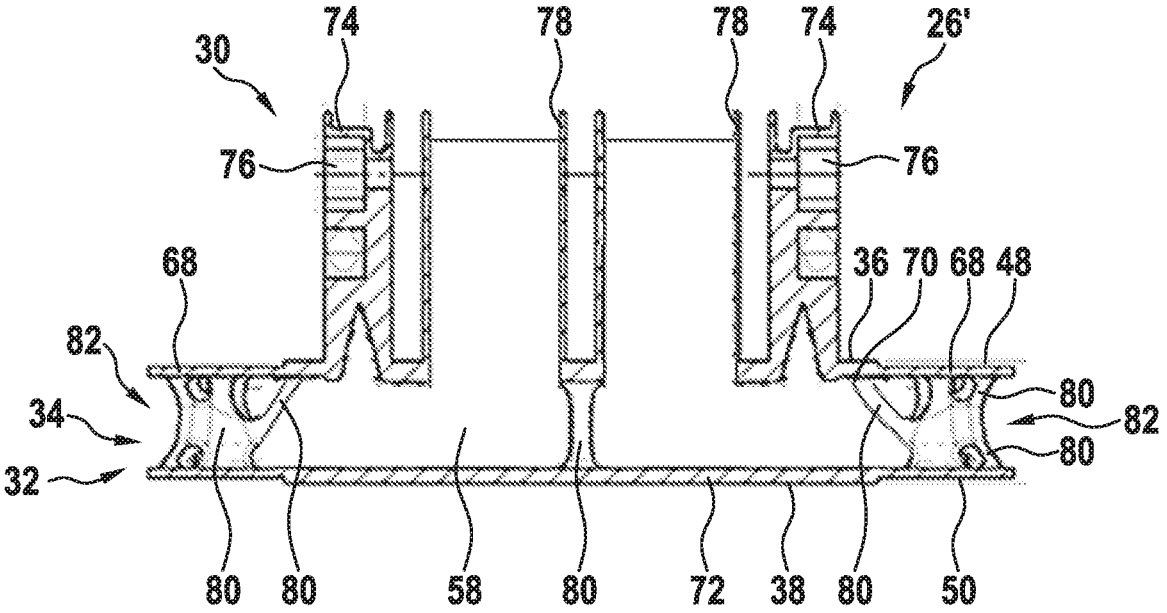
FIG. 5 shows a cross-section of a plunger of a switch assembly according to a further embodiment of the invention.
Figure 6:
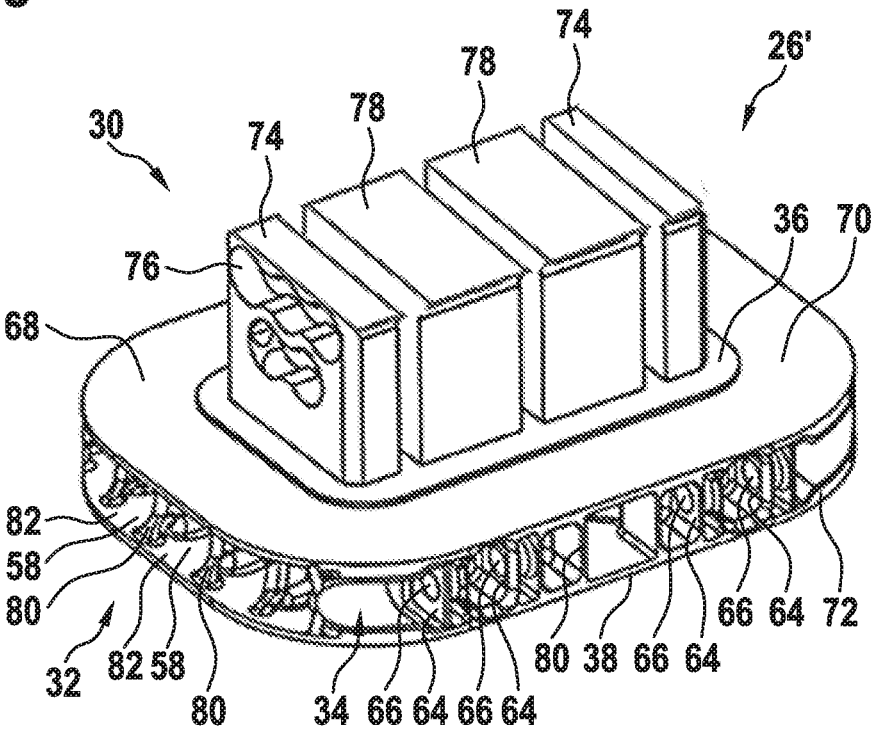
FIG. 6 shows a perspective view of the plunger of FIG. 5.

FIGS. 5 and 6 show an embodiment of a plunger 26', which is made by 3D printing, for example with a Ti alloy. As the plunger 26 of FIGS. 3 and 4, the plunger 26' also has a connection member 30 with four arms 74, 78 and a mechanical structure 34 with a top plate 70 and a bottom plate 72. The inner arms 78 are hollow members, which are composed of outer walls, in which the holes 76 are provided.

Analogously to FIGS. 3 and 4, the mechanical structure 34 also has a top plate 70 and a bottom plate 72. Furthermore, attachment plates 64 with holes 66 are present at opposite sides of the mechanical structure.

The space between the top plate 70 and a bottom plate 72 is filled with a network of struts 80 that interconnect the top plate 70 and a bottom plate 72. The struts are designed in such a way that more than 50%, or more than 80%, of the volume between the top side 36 and the bottom side 38 is empty, i.e. not filled with the material of the mechanical structure 34.

Furthermore, the area of a cross section through the mechanical structure in the middle between the top side 36 and the bottom side 38 is less than 20% of the area of the top side 36 or the bottom side 38.

As shown in FIG. 5, struts 80 may join and/or may split up into two or more struts 80 between the top plate 70 and a bottom plate 72. At least some of the struts 80 may have a continuously changing shape and/or maximal diameter along their extension direction.

Some of the struts 80 may be aligned in parallel to the movement direction D of the plunger 26. Other struts 80 may be inclined and may be aligned towards the connection member 30, such that forces are absorbed in an optimal way.

Between the struts 80 several channels 58 run in a transverse direction through the plunger 26'. These channels 58 may be aligned in parallel to each other and/or may have openings 82 towards a narrow side of the plunger 26.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practising the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfil the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

10 electrical switch assembly
12 terminal

14 contact element
16 drive
18 paddle
20 housing
22 housing
24 chamber
26 plunger
26' plunger
28 bistable suspension
30 connection member
32 base
34 mechanical structure
36 top side
38 bottom side
D moving direction
40 opening
42 piston
44 cylinder
46 spring
47 link
48 electrically conducting top face
50 electrically conducting bottom face
52 Thomson coil
54 top coil
56 bottom coil
58 channel/bore
60 cavity
61 sensor
62 bar, post
64 attachment plate
66 hole
68 depression
70 top plate
72 bottom plate
74 arm
76 hole
78 arm
80 strut
82 opening

The invention claimed is:

1. An electrical switch assembly, comprising:
a contact element to be moved towards a further contact element for generating an electrical connection; and
a drive for moving the contact element;
wherein the drive comprises a plunger with a connection member interconnected with the contact element,
wherein the plunger comprises a mechanical structure with a top side to which the connection member is connected, and a bottom side opposite to the top side, wherein an electrically conducting top face is on the top side and an electrically conducting bottom face is on the bottom side;
wherein the drive comprises a Thomson coil for moving the plunger via the electrically conducting top face and the electrically conducting bottom face;
wherein the mechanical structure comprises at least one channel between the top side and the bottom side, the at least one channel extending transverse to a movement direction of the plunger;
wherein the mechanical structure fills less than 50% of a volume between the top side and the bottom side.

2. The electrical switch assembly of claim 1, wherein a cross section through the mechanical structure parallel to the bottom side has an area less than 20% of the area of the bottom side.

3. The electrical switch assembly of claim 1,
wherein the mechanical structure comprises a top plate at the top side and a bottom plate at the bottom side.

4. The electrical switch assembly of claim 1,
wherein the top side and the bottom side are interconnected with struts;
wherein at least some of the struts are inclined with respect to the top side and the bottom side.

5. The electrical switch assembly of claim 1, wherein for at least some of the struts, the extension direction of the struts is directed towards the connection member.

6. The electrical switch assembly of claim 1, wherein the mechanical structure has an irregular pattern; and/or
wherein struts of the mechanical structure are arranged in an irregular pattern.

7. The electrical switch assembly of claim 1, wherein the plunger comprises a cavity, in which a sensor is arranged.

8. The electrical switch assembly of claim 1, wherein at least a part of the mechanical structure is obtained by additive manufacturing methods.

9. The electrical switch assembly of claim 1,
wherein at least a part of the mechanical structure is obtained by machining the channels and/or cavities into a solid block of material;
wherein the mechanical structure comprises a plurality of channels running parallel to each other and parallel to the top side and the bottom side.

10. The electrical switch assembly of claim 1, wherein the mechanical structure and the connection member are one-piece.

11. The electrical switch assembly of claim 1, wherein the connection member comprises at least one arm protruding orthogonal from the top side and having holes for connecting the contact element.

12. The electrical switch assembly of claim 11,
wherein at least one of the arms is hollow.

13. The electrical switch assembly of claim 1,
wherein the drive comprises a bistable suspension for holding the plunger in a top position and a bottom position;
wherein the mechanical structure comprises attachment plates, which are aligned orthogonal to the top side and the bottom side and each of which has a hole for connecting the bistable suspension-.

14. The electrical switch assembly of claim 1,
wherein the bistable suspension comprises a link connected to at least one of the attachment plates and to a piston movable in a cylinder orthogonal to the movement direction of the plunger.

15. The electrical switch assembly of claim 1, further comprising:
a second drive for moving the further contact element towards the contact element.

16. The electrical switch assembly of claim 2, wherein the mechanical structure comprises a top plate at the top side and a bottom plate at the bottom side.

17. The electrical switch assembly of claim 2, wherein the top side and the bottom side are interconnected with struts;
wherein at least some of the struts are inclined with respect to the top side and the bottom side.

18. The electrical switch assembly of claim 2, wherein for at least some of the struts, the extension direction of the struts is directed towards the connection member.

19. The electrical switch assembly of claim 2, wherein the mechanical structure has an irregular pattern; and/or
wherein struts of the mechanical structure are arranged in an irregular pattern.

20. The electrical switch assembly of claim 2, wherein the plunger comprises a cavity, in which a sensor is arranged.

* * * * *